US008003176B2

(12) United States Patent
Ylitalo et al.

(10) Patent No.: US 8,003,176 B2
(45) Date of Patent: Aug. 23, 2011

(54) INK RECEPTIVE ARTICLE

(75) Inventors: Caroline M. Ylitalo, Stillwater, MN (US); Chester A. Bacon, Jr., Oakdale, MN (US); Christopher K. Haas, St. Paul, MN (US); James M. Jonza, Woodbury, MN (US); Mark J. Pellerite, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1100 days.

(21) Appl. No.: 11/538,611

(22) Filed: Oct. 4, 2006

(65) Prior Publication Data

US 2008/0085385 A1 Apr. 10, 2008

(51) Int. Cl.
*B41M 5/40* (2006.01)

(52) U.S. Cl. ..... 428/32.13; 428/32.26; 428/32.34; 428/32.38

(58) Field of Classification Search ..... 428/32.13, 428/32.26, 32.34, 32.38
See application file for complete search history.

(56) References Cited

U.S. PATENT DOCUMENTS

| | | | | |
|---|---|---|---|---|
| 4,714,716 | A | 12/1987 | Park | |
| 4,916,198 | A | 4/1990 | Scheve et al. | |
| 4,940,736 | A | 7/1990 | Alteepping et al. | |
| 5,023,129 | A | 6/1991 | Morganti et al. | |
| 5,429,856 | A | 7/1995 | Krueger et al. | |
| 5,508,105 | A | 4/1996 | Orensteen et al. | |
| 5,518,809 | A | 5/1996 | Henry et al. | |
| 5,605,936 | A | 2/1997 | DeNicola, Jr. et al. | |
| 5,660,919 | A | 8/1997 | Vallee et al. | |
| 5,834,098 | A | 11/1998 | Kitamura et al. | |
| 5,882,774 | A | 3/1999 | Jonza et al. | |
| 6,360,035 | B1 | 3/2002 | Hurst, Jr. et al. | |
| 6,436,515 | B1 * | 8/2002 | Ohbayashi et al. | 428/32.33 |
| 6,464,351 | B1 | 10/2002 | Landry-Coltrain et al. | |
| 6,531,230 | B1 | 3/2003 | Weber et al. | |
| 6,589,636 | B2 * | 7/2003 | Emslander et al. | 428/195.1 |
| 6,696,390 | B1 | 2/2004 | Hatada et al. | |
| 6,720,042 | B2 | 4/2004 | Ylitalo et al. | |
| 6,723,433 | B2 | 4/2004 | Bacon, Jr. | |
| 6,897,183 | B2 | 5/2005 | Arrington et al. | |
| 2002/0022118 | A1 * | 2/2002 | Sarkar et al. | 428/195 |
| 2002/0094418 | A1 * | 7/2002 | Landry-Coltrain et al. | 428/195 |
| 2002/0142141 | A1 | 10/2002 | Miller | |
| 2002/0164460 | A1 | 11/2002 | Bacon, Jr. | |
| 2003/0072931 | A1 | 4/2003 | Hebrink et al. | |
| 2003/0077429 | A1 * | 4/2003 | Schulz | 428/195 |
| 2003/0207094 | A1 | 11/2003 | Carls et al. | |
| 2003/0228428 | A1 | 12/2003 | Kim et al. | |
| 2003/0232210 | A1 | 12/2003 | Haas et al. | |
| 2004/0018344 | A1 | 1/2004 | Watkins et al. | |
| 2004/0048073 | A1 | 3/2004 | Bacon, Jr. | |
| 2005/0129883 | A1 | 6/2005 | Snow | |
| 2008/0247788 | A1 * | 10/2008 | Ayaki et al. | 399/321 |

FOREIGN PATENT DOCUMENTS

| | | |
|---|---|---|
| EP | 615788 | 9/1994 |
| WO | 91/12372 | 8/1991 |
| WO | 99/03929 | 1/1999 |
| WO | 99/36466 | 7/1999 |
| WO | 99/61520 | 12/1999 |
| WO | 00/00520 | 1/2000 |
| WO | 00/68714 | 11/2000 |
| WO | 02/00412 | 1/2002 |
| WO | 03/039883 | 5/2003 |

OTHER PUBLICATIONS

Rohm and Haas, Dec. 1996.*

J.I. Raukola, "A New Technology to Manufacture Polypropylene Foam Sheet and Biaxially Oriented Foam Film," VTT Publications 361, Technical Research Centre of Finland, 101 pages, Espoo, 1998.

* cited by examiner

*Primary Examiner* — Betelhem Shewareged

(57) ABSTRACT

An ink receptive article including a substrate having applied on at least a portion thereof a layer of an ink receptive coating, wherein the ink receptive coating layer includes a cross-linked polymer and an ink absorbing polymer, wherein the ink absorbing polymer has a solubility parameter of equal to or less than 9 $(cal/cm^3)^{1/2}$.

15 Claims, 1 Drawing Sheet

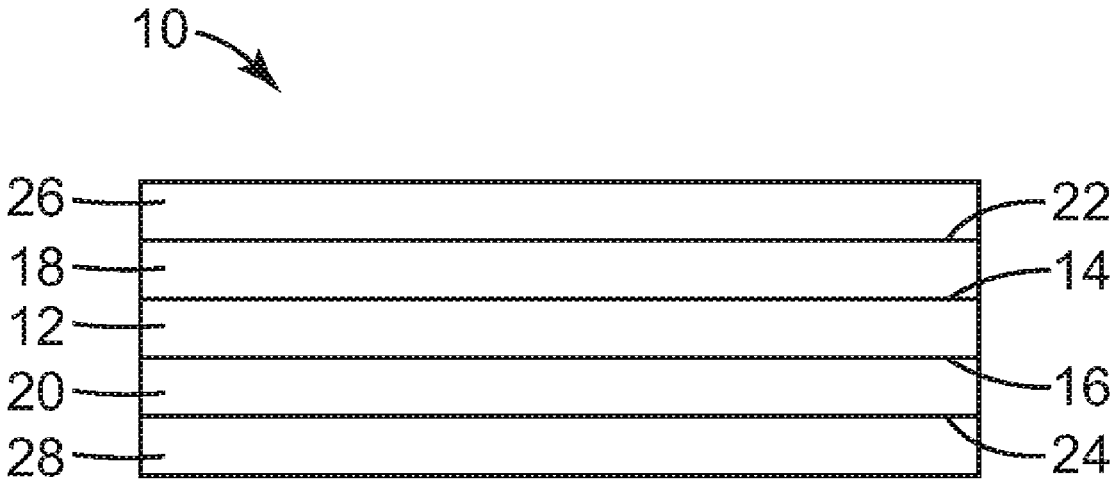
10
26
18
12
20
28
22
14
16
24

INK RECEPTIVE ARTICLE

The present disclosure is directed to an article having an ink-receptive layer applied thereon, and a method of making the article.

BACKGROUND

Conventional security documents such as currency, stock and bond certificates, birth and death certificates, land titles and the like are typically made of paper. However, paper, even the more durable security paper, is not a particularly durable. Since polymeric materials may be more resistant to damage caused by handling, environmental exposure and water, certain polymeric materials may be used to replace paper for security document applications.

Polymeric documents offer several benefits over their paper counterparts. In particular, polymeric security documents can offer greatly increased durability and resistance to counterfeiting through the incorporation of security features. The polymeric security documents may also have certain physical properties that are similar to the more commonly used paper banknotes, such as tactile feel, strength, tear resistance, handling, folding, and crumple resistance.

However, the capture of the image-forming ink on polymeric substrates presents a technical challenge because plastic film is substantially impervious to liquids. For example, U.S. 2003/0232210 A1, incorporated herein by reference, describes security document substrates made from oriented foam polyolefin films. An ink receptive surface is provided on the oriented polyolefin foam to capture and retain an image forming ink. The ink receptive surface is prepared by corona or flame treating the surface of the oriented foam polymeric film, by applying to the oriented foam polymeric film a suitable ink receptive primer coating, or by laminating or coextruding onto the oriented foam polymeric film an ink receptive polymer film.

Typically, ink receptive coatings are made of highly filled binder compositions where the filler content usually is greater by weight than the polymer binder. Such high filler concentration is needed to create micro porous structures in the coating, where the ink is absorbed into the pores by capillary action. For synthetic films made of polyolefin materials, coatings with high filler content have very poor adhesion to the substrate. Therefore, there is a need to develop ink receptive coatings for substrates that have low filler content with good ink absorption and good adhesion to the substrate.

SUMMARY

In one aspect, the present disclosure is directed to an ink receptive article including a substrate having applied on at least a portion thereof a layer of an ink receptive coating, wherein the ink receptive coating layer includes a cross-linked polymer and an ink absorbing polymer, wherein the ink absorbing polymer has a solubility parameter of equal to or less than 9 $(cal/cm^3)^{1/2}$.

In another aspect, this disclosure is directed to an ink receptive article including an oriented polypropylene foam layer having an ink receptive layer on at least a portion of a major surface thereof, wherein the ink receptive layer includes a blend of a crosslinked urethane polymer as a major component and a low solubility parameter ink absorbing polymer as a minor component.

In yet another aspect, this disclosure is directed to a process for making an ink-receptive article including coating on a substrate a coating solution including a polyurethane, an ink absorbing polymer having a solubility parameter of equal to or less than 9 $(cal/cm^3)^{1/2}$, a crosslinker and a solvent; and drying the coating solution to form an ink receptive layer.

In another aspect, this disclosure is directed to an ink receptive article including a thermoplastic film layer, an oriented polypropylene foam layer on each major surface of the thermoplastic film layer, and an ink receptive layer on at least a portion of a major surface of a foam layer, the ink receptive layer including a blend of at least two polymers wherein the blend includes 95% to 52% a crosslinked polyurethane and 5% to 48% of an ink absorbing polymer selected from the group consisting of polymers and copolymers derived from ethylene, propylene, isoprene, butadiene, octane, and combinations thereof, atactic polypropylene, and ethylene/propylene copolymer waxes derived from saturated, unsaturated, linear or cyclic olefins.

In yet another aspect, this disclosure is directed to a security document including a substrate having applied on at least a portion thereof a layer of an ink receptive coating, wherein the ink receptive coating layer includes a cross-linked polymer and an ink absorbing polymer, wherein the ink absorbing polymer has a solubility parameter of equal to or less than 9 $(cal/cm^3)^{1/2}$.

The ink receptive article is particularly useful in the preparation of printed security documents such as currency, stock and bond certificates, birth and death certificates, passport pages, checks, titles and abstracts and the like. These articles exhibit improved crumple and crease recovery compared to previously known multilayer optical films, synthetic papers, or currency papers. The proper modulus and tear strength, superior folding endurance, and crumple and crease recovery properties fit the market need for increased durability.

The ink receptive articles described in this disclosure may optionally include security characteristics, such as color shifting inks or films, embossments, translucent or transparent regions, holographic indicia and the like.

The ink receptive layer described in this disclosure is suitable for use with a wide variety of inks. The ink receptive article described in this disclosure also exhibits improved static dissipation properties, which make sheets of the polymeric materials to which the primer coating is applied easier to handle and feed into counting and printing machines. In addition, the ink receptive article described in this disclosure also provides to the polymeric security document substrate improved anti-blocking properties. These anti-blocking properties make the sheets to which the ink receptive coating is applied less likely to adhere to one another prior to printing, and provide an air gap that allows drying or curing of the inks after printing. The ink receptive article described in this disclosure also provides enhanced resistance to attack by chemicals frequently encountered in environments where currency and security documents are used.

BRIEF DESCRIPTION OF THE FIGURES

FIG. 1 is a cross sectional view of a multilayer ink receptive article.

DETAILED DESCRIPTION

In one aspect, this disclosure describes an ink receptive article including an ink receptive coating layer on a substrate. The ink receptive coating layer is typically formulated to provide a level of ink receptivity tuned for a particular printing technique and related ink used in that printing technique.

The ink receptive coating layer must also survive a variety of chemical and mechanical failure tests used to evaluate printed security documents.

The ink receptive coating layer includes a crosslinked polymer and an ink absorbing polymer having a low solubility parameter. Typically, the crosslinked polymer, which forms a major portion of the ink receptive coating layer, forms a cross-linked matrix, and the ink absorbing polymer, which forms the minor portion of the ink receptive coating layer, forms a disperse phase within the cross-linked matrix. While not wishing to be bound by any theory, in this typical polymer blend the ink absorbing polymer provides ink absorption and the cross-linked polymer provides chemical durability.

If the ink absorbing polymer in the ink receptive coating layer is to absorb inks and provide good ink receptivity, its solubility parameter should be closely matched to that of the ink vehicle to be applied on the ink receptive layer. In the present disclosure, the terminology "solubility parameter" refers to the Hildebrand solubility parameter, which is a solubility parameter represented by the square root of the cohesive energy density of a material, having units of (pressure)$^{1/2}$, and being equal to $(\Delta H\text{-}RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in: Barton, A. F. M., *Handbook of Solubility and Other Cohesion Parameters,* 2$^{nd}$ Ed. CRC Press, Boca Raton, Fla., (1991), for monomers and representative polymers in *Polymer Handbook,* 3$^{rd}$ Ed., J. Brandrup & E. H. Immergut, Eds. John Wiley, NY pp. 519-557 (1989), and for many commercially available polymers in Barton, A. F. M., *Handbook of Polymer-Liquid Interaction Parameters and Solubility Parameters*, CRC Press, Boca Raton, Fla., (1990).

The ink absorbing polymer may vary widely depending on the intended application, but in general the ink absorbing polymer should preferably have a solubility parameter value equal to or less than 9 $(cal/cm^3)^{1/2}$. This low solubility parameter makes the ink receptive coating layer particularly suited for solvent based inks used in security printing applications. Such inks typically include mineral spirits as the main solvent in the vehicle. Such solvents are non-polar with very low solubility parameter of 7 $(cal/cm^3)^{1/2}$.

The ink absorbing polymer may be selected from any olefin polymer or copolymer with sufficiently low crystallinity to absorb solvents used in widely used printing inks and processes such as, for example, mineral sprits, and exhibits a low solubility parameter. Suitable olefin polymers and copolymers include, for example, polymers derived from ethylene, propylene, isoprene, butadiene, and octane, as well as atactic polypropylene, ethylene/propylene copolymers and other non-polar low crystallinity polyolefins. For example, Kraton polymers (available from Kraton Polymers, Houston, Tex.) can be used as the ink absorbing polymer component in the ink receptive coating to provide good ink absorption. Preferred Kraton polymers include Kraton 1107, which is a Styrene-Isoprene-Styrene block copolymer with solubility parameter of 7.4 $(cal/cm^3)^{1/2}$. Other useful Kraton polymers include Kraton 1102 and Kraton 1652. Still other useful ink absorbing polymers include those sold under the trade name Vistanex available from Exxon Mobil for example L-140 polyisobutylene.

The ink absorbing polymer may also be selected from waxes derived from saturated, unsaturated, linear or cylic olefins.

The ink absorbing polymer typically makes up at least 5% and up to 48% of the total polymer content of the coating, and more preferably between 15% and 35% of the total polymer content of the coating.

The crosslinked polymers making up the major portion of the ink receptive layer typically provide enhanced chemical resistance. The amount of cross-linking in the ink receptive layer should be carefully controlled to maintain a balance between chemical resistance and a desired level of adhesion of the ink receptive layer to a substrate. Increased crosslink density tends to reduce both ink absorption in the ink receptive layer and adhesion of the ink receptive layer to the foam or non-foam layer.

The crosslinked polymer is preferably selected from polyurethanes, polyureas, polyethers, polyesters, polyacrlylics, copolymers thereof, and blends thereof. Solvent based polyurethanes are particularly preferred. While not wishing to be bound by any theory, the organic solvent typically penetrates into the olefin foam layer to provide good adhesion. Suitable polyurethanes include, for example, those available under the trade designation PERMUTHANE from Stahl USA, Peabody, Mass. For example, SU26-248, an aliphatic polyurethane in solvent (25% solids in toluene), is suitable. Other suitable polyurethanes include those available from SIA Adhesives, Inc (Seabrook N.H.) such as QC4820, an aliphatic polyurethane in solvent (27% solids in propylene glycol monomethyl ether), Estanes available from B.F. Goodrich (Cleveland, Ohio), such as Estane 5715 and 5778, and Morthanes available from Huntsman polyurethanes (Ringwood, Ill.), such as CA118 and CA237, both are polyester polyurethanes. Other suitable polymers include those available from Neoresins DSM under the trade designation U-371.

Preferred crosslinkers for use in the ink receptive layer include isocyanates such as those available under the trade designation DESMODUR from Bayer AG (Pittsburgh, Pa.), particularly DESMODUR N-75 BA/X (aliphatic polyisocyanate, 75% solids in n-butyl acetate, xylene blend). The concentration of the selected crosslinker in the coating solution for the ink receptive layer should be selected with regard to maintaining a balance between chemical resistance and a desired level of adhesion of the ink receptive layer to the foam or non-foam layer. The preferred ratio of cross-linker to the crosslinked polymer (cross-linker:polyurethane) is from 1:10 to 1:2 by weight, more preferably from 1:5 to 1:3.

In addition to the polymeric or resin components, the ink receptive layer may contain other components such as a dye mordant, a surfactant, particulate materials, a colorant, an ultraviolet absorbing material, an organic acid, an optical brightener, antistatic agents, antiblocking agents and the like.

Antistatic agents may be included in the ink receptive coating layer, or may also optionally be present in a layer adjacent the ink receptive coating layer. A wide range of antistatic agents are suitable, but preferred antistatic agents are colorless, neutral to the other components in the ink receptive coating, not viscosity prohibitive, and conductive. Preferred antistatic agents include those available under the trade designation CYASTAT from Cytec Industries, Inc. (West Paterson, N.J.), as well as those available under the trade designation KENSTAT from Kendrick Petrochemicals, Inc., (Bayonne, N.J.). Vanadium pentoxide may also be used, but it is not particularly compatible with solvent based systems, and may optionally be applied as a second thin layer over or under the ink receptive coating layer. Preferred antistatic agents to be used in the ink receptive layer are quaternary ammonium compounds such as Cyastat 609, a quaternary ammonium compound in isopropanol available from Cytec Industries. The concentration of the antistatic agent depends on the type of agent used. Typically, the amount of antistatic agent ranges from 1% and up to 50% by weight of the dry ink receptive coating. For example, when Cyastat type antistatic agent is used, the preferred concentration is between 5% and 20% of the dry coating weight.

Antiblocking properties of the articles described herein are important to provide good feeding into printing machines. This property may be measured by standard friction tests. Given the non-absorbing nature of the foam and non-foam substrates, it is preferred to provide a surface texture for the ink receptive layer that would allow an air gap between sheets of the printed substrate film material. For example, currency inks generally cure via oxidation, so a pathway for oxygen to reach the ink is important in solidifying the ink. The ink receptive coating layer may optionally include beads or particles that have a diameter similar to or greater than the dry coating thickness of the layer. For example, glass microspheres, crosslinked polymer beads, and porous silica beads and combinations thereof may be incorporated into the ink receptive layer or the foam or non-foam substrate films to provide antiblocking properties. Cross-linked polymer beads are the preferred antiblocking agent for the coating. Such beads are preferred over glass beads because they do not dull the cutting blades when the substrate is cut into sheets, and they can be obtained in monodisperse sizes. Typical concentration ranges from 2% to 20% by weight of the dry coating weight, and more preferably between 5% and 15% of the dry coating weight. The diameter of the polymer beads should preferably be greater than the dry coating thickness so that the beads act as spacers.

The ink receptivity of the ink receptive coating may be improved by adding ink absorbers, which are typically inorganic particles such as metal oxides and silicas. Preferred metal oxides include titanium oxides such as rutile, titanium monoxide, titanium sesquioxide; silicon oxides, surfactant coated silica particles, zeolites, and surface treated derivatives thereof such as for example fluorinated silicas as described in PCT published patent application No. WO 99/03929; aluminum oxides, for example boehmite, pseudoboehmite, bayerite, mixed oxides such as aluminum oxyhydroxide, alumina particles having a silica core; zirconium oxides such as zirconia and zirconium hydroxide; and mixtures thereof. Silicon oxides (silicas) and aluminum oxides (aluminas) are especially preferred.

Silicas useful in the ink receptive layer include amorphous precipitated silicas, fumed silicas, or mixtures thereof. Such silicas have typical primary particle sizes ranging from about 15 nm to about 10 μm, preferably about 100 nm to about 10 μm. These particle sizes span a wide range in part because two different types of silicas may be used in the ink absorbing layer.

In general, increasing the amount of inorganic additive in the ink receptive layer improves ink absorption, but also increases the viscosity of the coating solution used to make the layer and reduces its adhesion to the plastic substrate. A typical concentration range for the inorganic additive in the ink receptive coating ranges between about 5% and about 20% by weight of the dry coating. An example of a suitable fumed silica is available under the trade designation CAB-O-SIL from Cabot Corporation, (Billierica, Mass.). Another suitable silica material that is useful as an ink absorber is a porous amorphous silica bead available under the trade designation GASIL from Ineos Silicas, Ltd, (Wannington, England). The surface of the silica may optionally be treated with, for example, PDMS, which helps disperse the silica in solvent without the formation of gels via physical crosslinking.

Dye mordants may also optionally be used to fix the printed ink to the ink receptive layer. Any conventional dye mordant may be used such as, for example polymeric quaternary ammonium salts, poly(vinyl pyrrolidone), and the like. Optical brighteners that may be used to enhance the visual appearance of the imaged layer may be any conventional, compatible optical brightener, e.g., such as optical brighteners marketed by Ciba-Geigy under the trade designation TINOPAL.

In addition to the ink absorbing inorganic materials described above, the ink receptive layer may also contain a particulate additive to enhance the smoothness characteristics of the surface of the ink receptive layer, particularly after it has been printed. Suitable particulate additives includes inorganic particles such as silicas, chalk, calcium carbonate, magnesium carbonate, kaolin, calcined clay, pyrophylite, bentonite, zeolite, talc, synthetic aluminum and calcium silicates, diatomatious earth, anhydrous silicic acid powder, aluminum hydroxide, barite, barium sulfate, gypsum, calcium sulfate, and the like; and organic particles such as polymeric beads including beads of polymethylmethacrylate, copoly(methylmethacrylate/divinylbenzene), polystyrene, copoly(vinyltoluene/t-butylstyrene/methacrylic acid), polyethylene, and the like. Such polymeric beads may include minor amounts of divinylbenzene to crosslink the polymers. The ink receptive layer may also contain a colorant, e.g., a dye or pigment. This layer may contain components which strongly absorb ultraviolet radiation thereby reducing damage to underlying images by ambient ultraviolet light, e.g., such as 2-hydroxybenzophenones; oxalanilides; aryl esters and the like; hindered amine light stabilizers, such as bis(2,2,6,6-tetramethyl-4-piperidinyl) sebacate and the like; and combinations thereof. Ultraviolet light stabilizers can be present in amounts ranging from about 0.1 to about 5 weight percent of the dry coating weight. Commercially available UV absorbers are available from BASF Corp., Parsippany, N.J. under the trade designation "Uvinol 400"; Cytec Industries, West Patterson, N.J., under the trade designation "Cyasort UV 1164" and Ciba Specialty Chemicals, Tarrytown, N.Y., under the trade designations "Tinuvin 900", "Tinuvin 123", and "Tinuvin 1130". Free-radical scavengers can be present in an amount from about 0.05 to about 0.25 weight percent of the dry coating weight. Nonlimiting examples of free-radical scavengers include hindered amine light stabilizers (HALS) compounds, hydroxylamines, sterically hindered phenols, and the like. HALS compounds are commercially available from Ciba Specialty Chemicals under the trade designation "Tinuvin 292" and cytec Industries under the trade designation "Cyasorb UV 3581".

The ink receptive layer typically has a dry thickness of 1 μm to 50 μm, preferably 6 μm to 50 μm.

The ink receptive layer is preferably coated from a solvent-based coating solution that can be coated on and adhere to a particular foam or non-foam layer. The coating solution is then cured and/or dried to remove solvents present in the coating solution to form the finished ink receptive coating. Preferably, the ink-receptive coating is water and chemical resistant when cured and/or dried under appropriate conditions.

Suitable solvents for the coating solution include alcohols such as isopropyl alcohol (IPA) or ethanol; ketones such as methyl ethyl ketone (MEK), methyl isobutyl ketone (MIBK), diisobutyl ketone (DIBK); cyclohexanone, or acetone, aromatic hydrocarbons such as toluene; isophorone; butyrolactone; N-methylpyrrolidone; tetrahydrofuran; esters such as lactates and acetates such as dipropylene glycol monomethyl ether acetate (DMPA), and combinations of these and the like. Preferred solvents include toluene, MEK, and MIBK.

When applying an ink-receptive coating solution on an oriented foam substrate as described below, the ink receptive layer has a weight of between about 0.5 and about 250 g/m$^2$. In a preferred embodiment, the image receptive layer has a weight of between about 1 and about 100 g/m$^2$. In a particularly preferred embodiment, the image receptive layer has a weight of between about 2 and about 50 g/m$^2$. The coating weight can vary depending on fillers, inorganic materials, additives, etc.

Examples of application techniques for the ink receptive coating, which may be suitable in some applications, include coating, printing, dipping, spraying, and brushing. Examples of coating processes that may be suitable in some applications include direct and reverse roll coating such as Gravure, knife coating, spray coating, flood coating, and extrusion coating. Examples of printing processes that may be suitable in some applications include screen-printing and gravure printing. Alternatively, the ink receptive coating maybe coated onto a release liner and transfer coated onto the substrate.

Following the coating step, the coating solution is then cured and/or dried to form the ink receptive layer. Drying temperatures can vary depending on the solvents used. Drying can take place at room temperature or at elevated temperatures. Oven drying is preferred where oven temperatures ranging between 50° C. and 150° C. are optimum in order to initiate the cross-linking reaction in the coating and drive off the solvents in reasonable amount of time.

The substrate on which the ink receptive coating layer is coated may vary widely depending on the intended application. Typically, the substrate is a plastic film, and in a preferred embodiment is an oriented foam such as that described in U.S. 2003/0232210, which is incorporated herein by reference. Other films, such as nanolayer birefringent optical film, such as described in U.S. application 20030072931A1, as well as regions of a substrate that are impervious to ink due to vapor coatings (for example, interference and diffractive foils) also benefit from the ink receptive coatings of this invention. In these cases, the coating may cover only selected regions, allowing for the optical effect to be seen without any haze where there is no coating applied.

In one presently preferred embodiment, the ink receptive layer is part of a multilayer ink-receptive article including at least one oriented, high melt strength polypropylene foam layer such as that described in U.S. 2003/0232210. The ink receptive article also preferably includes at least one non-foam layer. Referring to FIG. 1, in one embodiment the ink receptive article 10 includes a non-foam layer 12, typically a thermoplastic film. On each major surface 14, 16 of the non-foam layer 12 is applied a foam layer 18, 20. A layer of an ink receptive coating 26, 28 is applied to at least a portion of each exposed major surface 22, 24 of the foam layers 18, 20.

The non-foam film layer 12 can be used in the multilayer article 10 to improve the physical properties of the article, including handling characteristics such as bending stiffness. As such, as shown in FIG. 1 the multilayer article preferably has the construction foam/film/foam, where one or both of the outermost foam layers are ink-receptive and the inner film layer is used to improve the handling properties such as bending stiffness. The foam/film/foam constructions, with the softer foam layers on the outside, feel more like paper.

The non-foam film layer 12 could also be a security film. This security film may contain transparent colored dyes, or opaque colored pigments, which may be easily differentiated when the security document is held up to view in transmitted light. Additionally, if the film is a multilayer optical film such as, for example, those described in U.S. Pat. Nos. 5,882,774, 6,531,230, or U.S. published patent application No. 2003/0072931 A1, this will be revealed more fully in the embossed regions, where foam cells are collapsed. The multilayer optical film may be oriented at the same temperature as the polypropylene foams, allowing for economical, one-step manufacturing. Alternatively, the film need not be continuous if it is placed inside the foam layers via lamination. In another embodiment, printing on the internal surface(s) with ordinary or security inks may be done prior to laminating foam layers together.

Polymeric materials used in the non-foam layer of the ink receptive articles shown in FIG. 1 include one or more melt-processible organic polymers, which may include thermoplastic or thermoplastic elastomeric materials. Thermoplastic materials are generally materials that flow when heated sufficiently above their glass transition temperature, or if semi-crystalline, above their melt temperatures, and become solid when cooled.

Thermoplastic materials useful in the ink receptive articles described in this disclosure that are generally considered nonelastomeric include, for example, polyolefins such as isotactic polypropylene, low density polyethylene, linear low density polyethylene, very low density polyethylene, medium density polyethylene, high density polyethylene, polybutylene, nonelastomeric polyolefin copolymers or terpolymers such as ethylene/propylene copolymer and blends thereof, ethylene-vinyl acetate copolymers such as those available under the trade designation ELVAX from E. I. DuPont de Nemours, Inc., Wilimington, Del.; ethylene acrylic acid copolymers such as those available under the trade designation PRIMACOR from E. I. DuPont de Nemours; ethylene methacrylic acid copolymers such as those available under the trade designation SURLYN from E. I. DuPont de Nemours, Inc.; ethylene vinyl actetate acrylate copolymers such as those available under the trade designation BYNEL from E. I. DuPont de Nemours, Inc.; polymethylmethacrylate; polystyrene; ethylene vinyl alcohol; polyesters including amorphous polyester; cycloaliphatic amorphous polyolefins such as those available under the trade designation ZEONEX available from Zeon Chemical, and polyamides. Fillers, such as clays and talcs, may optionally be added to improve the bending stiffness of the thermoplastic materials.

Preferred organic polymers and homo-and copolymers of polyolefins include polyethylene, polypropylene and polybutylene homo- and copolymers.

Thermoplastic materials that have elastomeric properties are typically called thermoplastic elastomeric materials. Thermoplastic elastomeric materials are generally defined as materials that act as though they were covalently crosslinked at ambient temperatures, exhibiting high resilience and low creep, yet process like thermoplastic nonelastomers and flow when heated above their softening point. Thermoplastic elastomeric materials useful in the ink receptive articles include, for example, linear, radial, star, and tapered block copolymers (e.g., styrene-isoprene block copolymers, styrene-(ethylene-butylene) block copolymers, styrene-(ethylene-propylene-) block copolymers, and styrene-butadiene block copolymers); polyetheresters such as those available under the trade designation HYTREL from E. I. DuPont de Nemours, Inc.; elastomeric ethylene-propylene copolymers; thermoplastic elastomeric polyurethanes such as those available under the trade designation MORTHANE from Morton International, Inc., Chicago, Ill.; polyvinylethers; polyalphaolefin-based thermoplastic elastomeric materials such as those represented by the formula $(CH_2CHR)_x$ where R is an alkyl group containing 2 to 10 carbon atoms, and polyalphaolefins based on metallocene catalysis such as AFFINITY, ethylene/polyalphaolefin copolymer available from Dow Plastics Co., Midland, Mich. In this application the term alphaolefin means an olefin having three or more carbon atoms and having a —CH=$CH_2$ group.

The foam layers 18, 20 of the multilayer ink receptive article in FIG. 1 are preferably oriented, high melt-strength polypropylene foams such as those described in U.S. 2003/0232210. The foam layers 18, 20 may be prepared by using a foamable mixture including a major amount of a high melt-strength polypropylene and a minor amount of second polymer component including a semicrystalline or amorphous thermoplastic polymer. Polymer mixtures including a high melt-strength polypropylene and two or more added polymers may also be used.

The high melt strength polypropylene useful in the foam layers 18, 20 includes homo- and copolymers containing 50 weight percent or more propylene monomer units, preferably at least 70 weight percent, and has melt strength in the range of 25 to 60 cN at 190° C. Melt strength may be conveniently measured using an extensional rheometer by extruding the polymer through a 2.1 mm diameter capillary having a length of 41.9 mm at 190° C. and at a rate of 0.030 cc/sec; the strand is then stretched at a constant rate while measuring the force to stretch at a particular elongation. Preferably the melt strength of the polypropylene is in the range of 30 to 55 cN, as described in WO 99/61520.

The melt strength of linear or straight chain polymers, such as conventional isotactic polypropylene, decreases rapidly with temperature. In contrast, the melt strength of highly branched polypropylenes does not decrease rapidly with temperature. Useful polypropylene resins are those that are branched or crosslinked. Such high melt strength polypropylenes may be prepared by methods generally known in the art. Reference may be made to U.S. Pat. No. 4,916,198 (Scheve et al) which describes a high melt strength polypropylene having a strain-hardening elongational viscosity prepared by irradiation of linear propylene in a controlled oxygen environment. Other useful methods include those in which compounds are added to the molten polypropylene to introduce branching and/or crosslinking such as those methods described in U.S. Pat. No. 4,714,716 (Park), WO 99/36466 (Moad, et al.) and WO 00/00520 (Borve et al.). High melt strength polypropylene may also be prepared by irradiation of the resin as described in U.S. Pat. No. 5,605,936 (Denicola et al.). Still other useful methods include forming a bipolar molecular weight distribution as described in J. I. Raukola, *A New Technology To Manufacture Polypropylene Foam Sheet And Biaxially Oriented Foam Film*, VTT Publications 361, Technical Research Center of Finland, 1998 and in U.S. Pat. No. 4,940,736 (Alteepping and Nebe), incorporated herein by reference.

The foamable polypropylene may be made solely of propylene homopolymer or may include a copolymer having 50 wt % or more propylene monomer content. Further, the foamable propylene may include a mixture or blend of propylene homopolymers or copolymers with a homo- or copolymer other than propylene homo- or copolymers. Particularly useful propylene copolymers are those of propylene and one or more non-propylenic monomers. Propylene copolymers include random, block, and grafted copolymers of propylene and olefin monomers selected from ethylene, C3-C8 alphaolefins and C4-C10 dienes. Propylene copolymers may also include terpolymers of propylene and alphaolefins selected from the group consisting of C3-C8 alphaolefins, wherein the alphaolefin content of such terpolymers is preferably less than 45 wt %. The C3-C8 alphaolefins include 1-butene, isobutylene, 1-pentene, 3-methyl-1-butene, 1-hexene, 3,4-dimethyl-1-butene, 1-heptene, 3-methyl-1-hexene, and the like. Examples of C4-C10 dienes include 1,3-butadiene, 1,4-pentadiene, isoprene, 1,5-hexadiene, 2,3-dimethyl hexadiene and the like.

Minor amounts (less than 50 percent by weight) of other semicrystalline polymers that may be added to the high melt strength polypropylene in the foamable composition include high, medium, low and linear low density polyethylene, fluoropolymers, poly(1-butene), ethylene/acrylic acid copolymer, ethylene/vinyl acetate copolymer, ethylene/propylene copolymer, styrene/butadiene copolymer, ethylene/styrene copolymer, ethylene/ethyl acrylate copolymer, ionomers and thermoplastic elastomers such as styrene/ethylene/butylene/styrene (SEBS), and ethylene/propylene/diene copolymer (EPDM).

Minor amounts (less than 50 percent by weight) of amorphous polymers may be added to the high melt strength polypropylene. Suitable amorphous polymers include, e.g., polystyrenes, polycarbonates, polyacrylics, polymethacrylics, elastomers, such as styrenic block copolymers, e.g., styrene-isoprene-styrene (SIS), styrene-ethylene/butylene-styrene block copolymers (SEBS), polybutadiene, polyisoprene, polychloroprene, random and block copolymers of styrene and dienes (e.g., styrene-butadiene rubber (SBR)), ethylene-propylene-diene monomer rubber, natural rubber, ethylene propylene rubber, polyethylene-terephthalate (PETG). Other examples of amorphous polymers include, e.g., polystyrene-polyethylene copolymers, polyvinylcyclohexane, polyacrylonitrile, polyvinyl chloride, thermoplastic polyurethanes, aromatic epoxies, amorphous polyesters, amorphous polyamides, acrylonitrile-butadiene-styrene (ABS) copolymers, polyphenylene oxide alloys, high impact polystyrene, polystyrene copolymers, polymethylmethacrylate (PMMA), fluorinated elastomers, polydimethyl siloxane, polyetherimides, amorphous fluoropolymers, amorphous polyolefins, polyphenylene oxide, polyphenylene oxide-polystyrene alloys, copolymers containing at least one amorphous component, and mixtures thereof.

In addition to the high melt strength polypropylene, the foam layer may contain other added components such as dyes, particulate materials, a colorant, an ultraviolet absorbing material, inorganic additives, and the like. Useful inorganic additives include $TiO_2$, $CaCO_3$, or high aspect ratio fillers such as wollastonite glass fibers and mica. The oriented, high melt-strength polypropylene foam may be prepared by the steps of:

(1) mixing at least one high melt strength polypropylene and at least one blowing agent in an apparatus having an exit shaping orifice at a temperature and pressure sufficient to form a melt mixture wherein the blowing agent is uniformly distributed throughout the polypropylene;

(2) reducing the temperature of the melt mixture at the exit of the apparatus to an exit temperature that is no more than 30° C. above the melt temperature of the neat polypropylene while maintaining the melt mixture at a pressure sufficient to prevent foaming;

(3) passing the mixture through the exit shaping orifice and exposing the mixture to atmospheric pressure, whereby the blowing agent expands causing cell formation resulting in foam formation, and (4) orienting the foam.

The foams thus produced have an average cell sizes less than 100 μm, and advantageously may provide foams having average cell sizes less than 50 μm, prior to the orientation step. Additionally the foams produced have a closed cell content of 70 percent or greater. As result of extrusion, and subsequent orientation, the original spherical cells may be elongated in the machine direction to assume an oblate ellipsoidal configuration. An extrusion process using a single-screw, double-screw or tandem extrusion system may prepare the foams for the foam layers. This process involves mixing one or more high melt strength propylene polymers (and any optional polymers to form a propylene polymer blend) with a blowing agent, e.g., a physical or chemical blowing agent, and heating to form a melt mixture. The temperature and pressure conditions in the extrusion system are preferably sufficient to maintain the polymeric material and blowing agent as a homogeneous solution or dispersion. Preferably, the polymeric materials are foamed at no more than 30° C. above the melting temperature of the neat polypropylene thereby producing desirable properties such as uniform and/or small cell sizes.

When a chemical blowing agent is used, the blowing agent is added to the neat polymer, mixed, heated to a temperature above the $T_m$ of the polypropylene (within the extruder) to ensure intimate mixing and further heated to the activation temperature of the chemical blowing agent, resulting in decomposition of the blowing agent. The temperature and pressure of the system are controlled to maintain substantially a single phase. The gas formed on activation is substantially dissolved or dispersed in the melt mixture. The resulting single-phase mixture is cooled to a temperature no more than 30° C. above the melting temperature of the neat polymer, while the pressure is maintained at or above 1000 psi (6.9 MPa), by passing the mixture through a cooling zone(s) in the extruder prior to the exit/shaping die. Generally the chemical blowing agent is dry blended with the neat polymer prior to introduction to the extruder, such as in a mixing hopper.

With either a chemical or physical blowing agent, as the melt mixture exits the extruder through a shaping die, it is exposed to the much lower atmospheric pressure causing the blowing agent (or its decomposition products) to expand. This causes cell formation resulting in foaming of the melt mixture. When the melt mixture exit temperature is at or below 30° C. above the $T_m$ of the neat polypropylene, the increase in $T_m$ of the polymer as the blowing agent comes out of the solution causes crystallization of the polypropylene, which in turn arrests the growth and coalescense of the foam cells within seconds or, most typically, a fraction of a second. This preferably results in the formation of small and uniform voids in the polymeric material. When the exit temperature is no more than 30° C. above the $T_m$ of the neat polypropylene, the extensional viscosity of the polymer increases as the blowing agent comes out of the solution and the polypropylene rapidly crystallizes. When a high melt strength polypropylene is used, the extensional thickening behavior is especially pronounced. These factors arrest the growth and coalescense of the foam cells within seconds or, most typically, a fraction of a second. Preferably, under these conditions, the formation of small and uniform cells in the polymeric material occurs. When exit temperatures are in excess of 30° C. above the $T_m$ of the neat polymer, cooling of the polymeric material may take longer, resulting in non-uniform, un-arrested cell growth. In addition to the increase in $T_m$, adiabatic cooling of the foam may occur as the blowing agent expands.

Either a physical or chemical blowing agent may plasticize, i.e., lower the $T_m$ and $T_g$ of, the polymeric material. With the addition of a blowing agent, the melt mixture may be processed and foamed at temperatures considerably lower than otherwise might be required, and in some cases may be processed below the melt temperature of the high melt strength polypropylene. The lower temperature can allow the foam to cool and stabilize i.e., reach a point of sufficient solidification to arrest further cell growth and produce smaller and more uniform cell sizes.

Chemical blowing agents are added to the polymer at a temperature below that of the decomposition temperature of the blowing agent, and are typically added to the polymer feed at room temperature prior to introduction to the extruder. The blowing agent is then mixed to distribute it throughout the polymer in un-decomposed form, above the melt temperature of the polypropylene, but below the activation temperature of the chemical blowing agent. Once dispersed, the chemical blowing agent may be activated by heating the mixture to a temperature above its decomposition temperature of the agent. Decomposition of the blowing agent liberates gas, such as $N_2$, $CO_2$ and/or water, yet cell formation is restrained by the temperature and pressure of the system. Useful chemical blowing agents typically decompose at a temperature of 140° C. or above and may include decomposition aides. Blends of blowing agents may be used.

Examples of such materials include synthetic azo-, carbonate-, and hydrazide-based molecules, including azodicarbonamide, azodiisobutyronitrile, benzenesulfonhydrazide, 4,4-oxybenzene sulfonyl-semicarbazide, p-toluene sulfonyl semi-carbazide, barium azodicarboxylate, N,N'-dimethyl-N, N'-dinitrosoterephthalamide and trihydrazino triazine. Specific examples of these materials are Celogen OT (4,4' oxybisbenzenesulfonylhydrazide), Hydrocerol BIF (preparations of carbonate compounds and polycarbonic acids), Celogen AZ (azodicarbonamide) and Celogen RA (p-toluenesulfonyl semicarbazide). Other chemical blowing agents include endothermic reactive materials such as sodium bicarbonate/citric acid bends that release carbon dioxide. Specific examples include products available from Reedy International Corp. under the trade designation SAFOAM.

The amount of blowing agent incorporated into the foamable polymer mixture is chosen to yield a foam having a void content in excess of 10%, more preferably in excess of 20%, as measured by density reduction. Generally, greater foam void content reduces the foam density, weight and material costs for subsequent end uses.

A single stage extrusion apparatus can be used to make the foams, and is the preferred process for use with chemical blowing agents. A twin-screw extruder may be used to form a melt mixture of the polypropylene and blowing agent, although it will be understood that a single screw extruder may also be used. The polypropylene is introduced into an extruder by means of a hopper. Chemical blowing agents are typically added with the polymer but may be added further downstream. A physical blowing agent may be added using fluid handling means at a location downstream from a point at which the polymer has melted.

When a chemical blowing agent is used, an intermediate zone is generally maintained at an elevated temperature sufficient to initiate the chemical blowing agent, followed by subsequent cooler zones. The temperature of the initial zone (s) of the extruder must be sufficient to melt the polypropylene and provide a homogenous melt mixture with the blowing agent(s). The final zone or zones of the extruder are set to achieve the desired extrudate exit temperature. Using a single stage extrusion process to produce a homogeneous foamable mixture requires mixing and transitioning from an operating temperature and pressure to an exit temperature and pressure over a shorter distance. To achieve a suitable melt mix, approximately the first half of the extruder screw may have mixing and conveying elements which knead the polymer and move it through the extruder. The second half of the screw may have distributive mixing elements to mix the polymer material and blowing agent into a homogeneous mixture while cooling. The operating and exit pressures (and temperatures) should be sufficient to prevent the blowing agent from causing cell formation in the extruder. The operating temperature is preferably sufficient to melt the polymer materials, while the last zone or zones of the extruder are preferably at a temperature that will bring the extrudate to the exit temperature.

At the exit end of the extruder, the foamable, extrudable composition is metered into a die having a shaping exit orifice. In general, as the blowing agent separates from the melt mixture, its plasticizing effect on the polymeric material decreases and the shear viscosity and elastic modulus of the polymeric material increases. The shear viscosity increase is much sharper at the $T_m$ than at the $T_g$, making the choice of foaming temperatures for semicrystalline polymers much more stringent than for amorphous polymers. As the temperature of the polymeric material approaches the $T_m$ of the neat polymer and becomes more viscous, the cells cannot as easily expand or coalesce. As the foam material cools further, it solidifies in the general shape of the exit-shaping orifice of the die.

The blowing agent concentrations, exit pressure, and exit temperature can have a significant effect on the properties of the resulting foams including foam density, cell size, and distribution of cell sizes. In general, the lower the exit temperature, the more uniform, and smaller the cell sizes of the foamed material. This is because at lower exit temperatures, the extensional viscosity is higher, yielding slower cell growth. Extruding the material at lower than normal extrusion temperatures, i.e. no more than 30° C. above the $T_m$ of the neat polymeric material, produces foams with small, uniform cell sizes. In general, as the melt mixture exits the die, it is preferable to have a large pressure drop over a short distance. Keeping the solution at a relatively high pressure until it exits the die helps to form uniform cell sizes. Maintaining a large pressure drop between the exit pressure and ambient pressure can also contribute to the quick foaming of a melt mixture. The lower limit for forming a foam with uniform cells will depend on the particular blowing agent/polymer system being used. In general, for the high melt strength polypropylene useful in the invention, the lower exit pressure limit for forming acceptably uniform cells is approximately 7 MPa (1000 psi), preferably 10 MPa (1500 psi), more preferably 14 MPa (2000 psi). The smallest cell sizes may be produced at low exit temperatures and high blowing agent concentrations. However at any given temperature and pressure, there is a blowing agent concentration at and above which polydispersity will increase because the polymer becomes supersaturated with blowing agent and a two phase system is formed.

The optimum exit temperature, exit pressure, and blowing agent concentration for a particular melt mixture will depend on a number of factors such as the type and amount of polymer(s) used; the physical properties of the polymers, including viscosity; the mutual solubility of the polymer(s) and the blowing agent; the type and amount of additives used; the thickness of the foam to be produced; the desired density and cell size; and whether the foam will be coextruded with another foam or an unfoamed material; and the die gap and die orifice design.

Further details regarding the preparation of the high melt strength oriented foams may be found in Assignee's published application WO02/00412. To optimize the physical properties of the foam, the polymer chains should preferably be oriented along at least one major axis (uniaxial), and may further be oriented along two major axes (biaxial). The degree of molecular orientation is generally defined by the draw ratio, that is, the ratio of the final length to the original length.

Upon orientation, greater crystallinity is imparted to the polypropylene component of the foam and the dimensions of the foam cells change. Typical cells have major directions X and Y, proportional to the degree of orientation in the machine and transverse direction respectively. A minor direction Z, normal to the plane of the foam, remains substantially the same as (or may be moderately less than) the cross-sectional dimension of the cell prior to orientation and therefore the density of the foam decreases with orientation. Subsequent to orientation, the cells are generally oblate ellipsoidal in shape. The conditions for orientation are chosen such that the integrity of the foam is maintained. Thus, when stretching in the machine and/or transverse directions, the orientation temperature is chosen such that substantial tearing or fragmentation of the continuous phase is avoided and foam integrity is maintained. The foam is particularly vulnerable to tearing, cell rupture or even catastrophic failure if the orientation temperature is too low or the orientation ratio(s) is/are excessively high. Generally the foam is oriented at a temperature between the glass transition temperature and the melting temperature of the neat polypropylene. Preferably, the orientation temperature is above the alpha transition temperature of the neat polymer. Such temperature conditions permit optimum orientation in the X and Y directions without loss of foam integrity.

After orientation the cells are relatively planar in shape and have distinct boundaries. Cells are generally coplanar with the major surfaces of the foam, with major axes in the machine (X) and transverse (Y) directions (directions of orientation). The sizes of the cells are uniform and proportional to concentration of blowing agent, extrusion conditions and degree of orientation. The percentage of closed cells does not change significantly after orientation when using high melt strength polypropylene. In contrast, orientation of conventional polypropylene foam results in cell collapse and tearing of the foam, reducing the percentage of closed cells. Cell size, distribution and amount in the foam matrix may be determined by techniques such as scanning electron microscopy. Advantageously, the small cell sizes increase the opacity of the foam article, compared to foams having larger cell sizes, and opacifying agents may not be required.

In the orienting step, the foam is stretched in the machine direction and may be simultaneously or sequentially stretched in the transverse direction. The stretching conditions are chosen to increase the crystallinity of the polymer matrix and the void volume of the foam. It has been found that an oriented foam has significantly enhanced tensile strength, even with a relatively low density when compared to unoriented foams. The foam may be biaxially oriented by stretching in mutually perpendicular directions at a temperature above the alpha transition temperature and below the melting temperature of the polypropylene. Generally, the film is stretched in one direction first and then in a second direction perpendicular to the first. However, stretching may be effected in both directions simultaneously if desired. If biaxial orientation is desired, it is preferable to simultaneously orient the foam, rather than sequentially orient the foam along the two major axes. It has been found that simultaneous biaxial orientation provides improved physical properties such as tensile strength and tear resistance as compared to sequential biaxial orientation, and enables the preparation of a foam/non-foam multilayer construction where the non-foam layer is a lower melting polymer.

In a typical sequential orientation process, the film is stretched first in the direction of extrusion over a set of rotating rollers, and then is stretched in the direction transverse thereto by means of a tenter apparatus. Alternatively, foams may be stretched in both the machine and transverse directions in a tenter apparatus. Foams may be stretched in one or both directions 3 to 70 times total draw ratio (MD×CD). Generally greater orientation is achievable using foams of small cell size; foams having cell size of greater than 100 micrometers are not readily oriented more than 20 times, while foams having a cell size of 50 micrometers or less could be stretched up to 70 times total draw ratio. In addition foams with small average cell size exhibit greater tensile strength and elongation to break after stretching.

The temperature of the polymer foam during the first orientation (or stretching) step affects foam properties. Generally, the first orientation step is in the machine direction. Orientation temperature may be controlled by the temperature of heated rolls or by the addition of radiant energy, e.g., by infrared lamps, as is known in the art. A combination of temperature control methods may be utilized. Too low an orientation temperature may result in tearing the foam and rupturing of the cells. Too high an orientation temperature may cause cell collapse and adhesion to the rollers. Orientation is generally conducted at temperatures between the glass transition temperature and the melting temperature of the neat polypropylene, or at about 110-170° C., preferably 110-140° C. A second orientation, in a direction perpendicular to the first orientation may be desired. The temperature of such second orientation is generally similar to or higher than the temperature of the first orientation.

After the foam has been stretched it may be further processed. For example, the foam may be annealed or heat-set by subjecting the foam to a temperature sufficient to further crystallize the polypropylene while restraining the foam against retraction in both directions of stretching.

If desired, transparent or translucent regions may be imparted to the foam article or the multilayer article by embossing the article under heat and/or pressure by techniques known in the art. This embossing step is preferably performed on the oriented article after the application of the ink receptive coating layer. The embossing collapses the cells of the foam layer resulting in a transparent or translucent region that resists photocopying.

The final thickness of the foam will be determined in part by the extrusion thickness, the degree of orientation, and any additional processing. The process provides thinner foams than are generally achievable by prior art processes. Most foams are limited in thickness by the cell size. The small cell sizes (<50 μm) in combination with the orientation allows foam thickness of 1 to 100 mils (about 25 to 2500 μm) and greater opacity than larger cell foams. For security document applications, it is preferred that the thickness of the oriented foam layer(s) be from about 1 to 10 mils (about 25 to 259 μm), preferably 2 to 6 mils (about 50 to 150 μm).

The above processing techniques may be used to produce multilayer articles including at least one high melt strength polypropylene foam layer. The foams may be coextruded with materials having substantially higher or lower processing temperatures from that of the foam, while still obtaining the desired structures and cell sizes. It would be expected that exposing the foam to an adjacent hot polymer as it is extruded, might cause the foam cells, especially those in direct contact with the hotter material, to continue to grow and coalesce beyond their desired sizes or might cause the foam material to melt or collapse. The foams may be coextruded with a non-foam thermoplastic polymer layer, or may be coextruded with an ink-receptive layer.

The coextrusion process described herein may be used to make a foam material including two layers or more. A layered material or article may be produced by equipping a die with an appropriate feedblock, e.g., a multilayer feedblock, or by using a multi-vaned or multi-manifold die such as a 3-layer vane die available from Cloeren, Orange, Tex. Materials or articles having multiple adjacent foam layers may be made with foam layers including the same or different materials. Foam articles made according to the processes described herein may include one or more interior and/or exterior foam layer(s). In such a case, each extrudable material, including the high melt strength polypropylene foamable material, may be processed using one of the above-described extrusion methods wherein melt mixtures are fed to different inlets on a multi-layer feedblock, or multi-manifold die, and are brought together prior to exiting the die. The layers foam in generally the same manner as described above for the extrusion process. The multi-layer process can also be used to extrude the foam with other types of materials such as thermoplastic films and adhesives. When a multi-layered article is produced, it is preferable to form adjacent layers using materials having similar viscosities and which provide interlayer adhesion.

When the multilayer article includes a foam layer and a film layer (on one or both surfaces), a greater degree of orientation and improved tensile properties may be possible, compared with single layer foam.

Multilayer foam articles can also be prepared by laminating nonfoam layers to a foam layer, or by layering extruded foams as they exit their respective shaping orifices, with the use of some affixing means such as an adhesive. Useful laminated constructions include the high melt strength polypropylene foam layer with a thermoplastic film layer or a scrim layer, such as a non-woven layer. Other techniques that can be used include extrusion coating and inclusion coextrusion, which is described in U.S. Pat. No. 5,429,856, incorporated by reference. The multilayer article may be oriented as previously described.

The multilayer ink receptive article may also have an optional tie layer between adjacent foam layers, non-foam layers or ink-receptive layers to improve adherence between them (not shown in FIG. 1). Useful tie layers include extrudable polymers such as ethylene vinyl acetate polymers, and modified ethylene vinyl acetate polymers (modified with acid, acrylate, maleic anhydride, individually or in combinations). The tie layer may consist of these materials by themselves or as blends of these polymers with the thermoplastic polymer component. Use of tie layer polymers is well known in the art and varies depending on the composition of the two layers to be bonded. Tie layers for extrusion coating could include the same types of materials listed above and other materials such as polyethyleneimine which are commonly used to enhance the adhesion of extrusion coated layers. Tie layers can be applied to the foam layer, non-foam layer or ink absorptive layer by coextrusion, extrusion coating, laminating, or solvent coating processes.

Preferably, the foam layers of multilayer ink receptive articles range in thickness from about 20 to about 100 mils thick (about 500 to 2500 μm). Each non-foam layer of a multilayer substrate may range from 1 to 40 mils (about 25 to 1000 μm). If the non-foam layer is an internal stiffening layer, the thickness is generally from about 10 to 30 mils (about 250 to 750 μm). If the non-foam layer is an ink-receptive thermoplastic film layer, the thickness is generally from about 1 to 4 mils (about 25 to 100 μm). The overall thickness of a multilayer article may vary depending on the desired end use, but for security documents, the thickness is generally from about 20 to 120 mils (about 500 to 3050 μm), prior to orientation.

The thickness (or volume fraction) of the multilayer article and the individual film and foam layers depend primarily on the end-use application and the desired composite mechanical properties of the multi-layered film. Such multilayer articles have a construction of at least 2 layers, preferably, at least 3 layers.

Depending on the polymers and additives chosen, thicknesses of the layers, and processing parameters used, the ink receptive articles will typically have different properties at different numbers of layers. That is, the same property (e.g., tensile strength, modulus, bending stiffness, tear resistance) may go through maximum at a different number of layers for two particular materials when compared to two other materials. For example, the foam layer generally has good tear propagation resistance, but poorer tear initiation resistance. Thermoplastic films generally have good tear initiation resistance, but poorer tear propagation resistance. A multilayer article having both a foam and thermoplastic film layer provides both desirable attributes. Each of the non-foam layers typically includes the same material or combination of materials, although they may include different materials or combinations of materials.

The multilayer films are typically prepared by melt processing (e.g., extruding). In a preferred method, the foam and non-foam layers are generally formed at the same time, joined while in a molten state, and cooled. That is, preferably, the layers are substantially simultaneously melt-processed, and more preferably, the layers are substantially simultaneously coextruded. Products formed in this way possess a unified construction and have a wide variety of useful, unique, and unexpected properties, which provide for a wide variety of useful, unique, and unexpected applications.

In a preferred method in accordance with the present invention, printed indicia, such a characters, images, text, logos, etc., are applied to the ink receptive layer utilizing a printing process. Many inks may be utilized in conjunction with the present invention including organic solvent-based inks, water-based inks, phase change inks, and radiation polymerizable inks. Depending on the printing technique used, preferred inks may include water-based inks. Inks utilizing various colorants may be utilized in conjunction with the present invention. Examples of colorants, which may be suitable in some applications, include dye-based colorants, and pigment based colorants. Examples of suitable printing methods include laser printing, gravure printing, offset printing, silk screen printing, electrostatic printing, intaglio and flexographic printing.

The ink-receptive article preferably includes one or more security features. Security features have been developed to authenticate security documents, and may be overt or covert. Overt security features include holograms and other diffractive optically variable images, transparent or translucent regions, embossed images, watermarks and color-shifting films or inks, while covert security features include images only visible under certain conditions such as inspection under light of a certain wavelength, polarized light, or retroreflected light. Even more sophisticated systems require specialized electronic equipment to inspect the document and verify its authenticity.

Suitable security features may include, for example, printed indicia or reverse printed indicia, or films such as color shifting films, metameric films, polarizing films, fluorescent films, luminescent films, phosphorescent films, pearlescent films, holographic films, reflective films, metallic films, and magnetic films. Additional examples of security features may include, for example, threads, particles or fibers, watermarks, embossments, and transparent and/or translucent regions. The security features may includes materials with optical properties such as, for example, liquid crystals, holograms, optical lenses, microlenses, Fresnel lenses, optical filters, polarizing filters, reflective elements, photochromic elements, thermochromic elements, Moiré patterns, and embossed images or other three dimensional elements. The security features may also include special inks such as, for example, color shifting inks, metameric inks, polarizing inks, fluorescent inks, luminescent inks, phosphorescent inks, pearlescent inks, holographic inks, reflective inks, metallic inks, and magnetic inks, or combinations thereof.

Examples of security features that may be suitable in some applications include a picture of a human face, serial numbers, a representation of a human fingerprint, a bar code, transparent regions, and a representation of a cardholder's signature and the like. One particularly useful security feature includes an embodiment wherein a colorant is added to a thermoplastic film layer in an embossed foam/film/foam construction. Normally, due to the opacity of the foam layers, the colorant in the film layer is not readily visible. However, on embossing one or both of the foam layers, a translucent region is created and the colored film is revealed.

In some embodiments, the security feature may be on a surface of the foam layer or the thermoplastic film layer, may be dispersed in the foam layer or the film layer, or may be laminated to the film layer or to the foam layer.

In some embodiments, the security feature may include a core embedded in the thermoplastic film layer, or a plurality of laterally spaced cores embedded in the thermoplastic film layer. The core may include a thermoplastic polymer with dyes or pigments, or may include particulate materials dissolved or dispersed therein. Suitable particulate materials include, for example, color shifting particles, metameric particles, polarizing particles, fluorescent particles, luminescent particles, phosphorescent particles, pearlescent particles, reflective particles, metallic particles, and magnetic particles, or combinations thereof.

In some embodiments, the security feature may be coextruded with the film layer or the foam layer using, for example, an inclusion coextrusion process.

In some embodiments, one or more security features in adjacent layers of the construction may be used in registration to provide a visual security feature.

Embossing can significantly reduce the light scattering from the, foam cell/polymer interfaces, leading to translucent or nearly transparent areas in the film layers and/or in the foam layers in the construction. Through the choice of embossing tooling, some areas containing indicia may remain unembossed (still substantially opaque), while other areas are substantially transparent, allowing verification in reflected or transmitted light. The transparency of the embossed indicia and the consistency of the light scattering in the unembossed regions are useful in determining that counterfeiting via the addition of a transparent film was not attempted. Other methods of reducing the light scattering of the foams are contemplated including vacuum, pressurized jets, peening, impingement with dot matrix print heads, and localized melting. Embossing of the article can provide a tactile security feature, which is desirable by the visually impaired.

In a foam/film/foam construction, the embossing may reveal the center film. This construction is particularly useful if the center film layer is a security film or a birefringent multilayer optical film. This may be particularly useful if the embossing process revealed some portions of the center film while leaving other regions unembossed. Another embodiment would include a center security film that provided different security features in the embossed and unembossed regions. For example, if the embossed region of the center security film provided one color in transmitted light while the unembossed region provided a different color in transmitted light, this two-fold security feature would be extremely difficult to replicate or counterfeit.

If desired, the article may be coated with a white opacifying coating and security printing inks may be used. Generally, an opacifying agent such as $TiO_2$ or $CaCO_3$ may be added to the ink-receptive coating. However, because the small foam cell size and scattering of incident light is naturally opacifying, additional opacifying agents may not be necessary. If desired, some regions may remain uncoated to allow for transparent or translucent regions of be embossed on the article, by the application of heat and/or pressure, which at least partially melts the foam layer and collapses the cells. The placement of the transparent region(s) may also be a security feature. Some of these transparent regions, or windows, may lack opacifying coatings on both sides, for viewing the transmitted light. Other windows may have no coating on one side, and a white or black coating on the opposite side.

Other security features may also be practiced, such as hot stamping of holograms (transparent or aluminum vapor coated), printing with color shifting and/or magnetic inks, and laser ablation to produce small holes that become apparent when held adjacent to a strong backlight.

EXAMPLES

Test Methods

The following test methods were used in the examples below.

Chemical Resistance Test Method:

18 mm squares of coated film or the coated and inked film were immersed in the designated chemical for 30 minutes. Swirling or stirring is used to maintain contact of the chemical with the coated film since the film floats. Upon removal, the sample is rubbed (lightly), and the coating and/or ink removal is scored according to this table:

| Condition | All came off | >50% came off | <50% came off | Minor change | Unaffected |
|---|---|---|---|---|---|
| Score | 0 | 1 | 2 | 3 | 4 |

The chemicals typically tested include: ethanol, acetone, xylene, gasoline, 20% acetic acid, 5% HCl, 5% sulfuric acid, 5% sodium hypochlorite (bleach), 5% NaOH, hydrogen peroxide, DEG (diethylene glycol), tetrachloroethylene, and synthetic sweat (DIN 53160).

Without cross-linking of the ink receptive layer, the chemical resistance of the solvent based polyurethane coatings was relatively poor with ratings of 0 or 1 for most of the solvents. However, when the coating polymer was cross-linked, then the ratings increased to 3 and 4 in general.

Ink Coating Method:

Ink was coated onto the substrates using a Little Joe Offset Proving Press. 0.2 ml of SICPA wet offset ink (red color) was added evenly over a 4"×6" area of the coated substrate.

Ink Receptivity Test Method:

After the oriented foam substrate was coated and inked, the sample was allowed to set for 30 seconds. The ink was then rubbed aggressively with clean Kim Wipe (folded several times to find clean spots) for 30 seconds. The ink receptivity was then given a rating as described below.

| Condition | All came off (<5% remains) | Most came off (>75%) | About 50% came off | Minor change | Unaffected |
|---|---|---|---|---|---|
| Score | 0 | 1 | 2 | 3 | 4 |

Static Dissipation Test Method:

A 3×5 inches sample of the coated substrate was charged, and charge dissipation time was measured ASTM COF test method D1894. Good static dissipation time was determined to be less than 0.1 seconds, and acceptable dissipation time was determined to be less than 1 second.

Friction Coefficient Measurement Test Method:

The static and dynamic coefficients of friction of the coated substrates were measured using the Instron Coefficient of Friction (COF) test method (TM 276), which is equivalent to ASTM COF test method D1894.

Ingredients and Materials

The table below depicts the trade designation, supplier, and supplier location for ingredients and materials used in the examples below.

| Generic Description | Trade Designation | Supplier (Location) |
|---|---|---|
| Matrix Polymer | | |
| Aliphatic polyurethane | "SU26-248" | Stahl USA (Peabody, MA) |
| Ink Absorbing Polymer | | |
| SIS block copolymer | "Kraton 1107" | Kraton Polymers (Houston, TX) |
| Cross-linker | | |
| Isocyanate | "N-75" | Bayer AG (Pittsburg, PA) |
| Inorganic Filler | | |
| Fumed silica | "Cabosil TS-720" | Cabot Corp. (Billierica, MA) |
| Porous silica beads | "Gasil 23F" | Ineos Silicas, Ltd, (Wannington, England) |
| Antistatic Agent | | |
| Quaternary Ammonium Compound | "Cyastat 609" | Cytec Industries, Inc. (West Paterson, NJ) |
| Antiblocking Agent | | |
| Acrylic beads | "MX-800S" | Esprix Technologies (Sarasota, FL) |
| Porous silica beads | "EBN" | Ineos Silicas, Ltd, (Wannington, England) |

Substrate

In all the examples below, the substrate used was a nitrogen corona treated oriented foam substrate such as that described in US2003/0232210.

Preparation of Kraton 1107 Solution:

In all the examples below, the Kraton 1107 solution was prepared by combining 12.5 parts of Kraton 1107 with 87.5 parts toluene and allowing the mixture to agitate in a heated bath (60° C.) for 4 hours until the Kraton was completely dissolved.

Example 1

The composition described in Table 1 was prepared by combining all ingredients and mixing at room temperature until well blended (for about one hour of high shear mixing).

TABLE 1

| Material | Material Description | Wet Parts | Dry Parts |
|---|---|---|---|
| SU 26-248 | Polyurethane in Toluene | 100 | 25 |
| N-75 | Isocyanate cross-linker | 10 | 7.5 |
| Cabosil TS-720 | Fumed silica | 4 | 4 |
| Kraton 1107 solution | Kraton in Toluene | 50 | 6.25 |
| Acrylic Beads | Antiblock agent | 7.5 | 7.5 |
| Cyastat 609 | Antistatic agent | 10 | 5 |
| MEK | | 101 | 0 |
| Total | | 282.5 | 55.25 |

The above composition was coated onto both sides of the oriented foam substrate using a reverse Gravure coating method. The dry coating thickness was approximately 8 micrometers (μm). Oven temperature was set at 82° C. and the line speed was 10 meters per minute.

Static dissipation of the above coated article was 0.02 seconds. Ink absorption rating was 2, and friction was 0.84 μs (static) and 0.70 μk (dynamic).

Example 2

The composition described in Table 2 was prepared by combining all ingredients and mixing at room temperature until well blended (for about one hour of high shear mixing).

TABLE 2

| Material | Material Description | Wet Parts | Dry Parts |
|---|---|---|---|
| SU 26-248 | Polyurethane in Toluene | 100 | 25 |
| N-75 | Isocyanate cross-linker | 10 | 7.5 |
| Ineos EBN | Antiblock agent/porous silica (8.5 μm) | 9.5 | 9.5 |
| Kraton 1107 solution | Kraton in Toluene | 50 | 6.25 |
| Ineos Gasil 23F | Antiblock agent/porous silica (6 μm) | 6 | 6 |
| Cyastat 609 | Antistatic agent | 10 | 5 |
| MEK | | 156 | 0 |
| Total | | 337.5 | 55.25 |

The above composition was coated onto both sides of the oriented foam substrate using a reverse Gravure coating method. Dry coating thickness was approximately 9 μm. Oven temperature was set at 82° C. and the line speed was 10 meters per minute. Static dissipation of the above coated article was 1.04 seconds, and ink absorption rating was 2.

Chemical resistance of samples from Examples 1 and 2 were evaluated and rated in Table 3 below.

TABLE 3

| Example | Acetone | Xylene | Gasoline | Sodium Hydroxide | Tetrachloroethylene |
|---|---|---|---|---|---|
| 1 | 3.5 | 3.5 | 3.5 | 4 | 4 |
| 2 | 3.5 | 4 | 4 | 4 | 4 |

Example 3

The blending ratio of Kraton to polyurethane was examined by making three coating compositions described in Table 4 below. All three coatings were coated using Meyer rod #18. The coating was dried for 5 minutes in a 55° C. oven.

TABLE 4

| Material | Composition 3A | Composition 3B | Composition 3C |
|---|---|---|---|
| SU 26-248 | 10 parts | 10 parts | 10 parts |
| N-75 | 1 parts | 1 parts | 1 parts |
| Cabosil TS-720 | 0.5 parts | 0.5 parts | 0.5 parts |
| Kraton 1107 solution | 5 parts | 10 parts | 15 parts |
| Acrylic Beads | 0.7 parts | 0.7 parts | 0.7 parts |
| Cyastat 609 | 1 parts | 1 parts | 1 parts |
| MEK | 10 parts | 10 parts | 10 parts |
| Antistatic properties | 0.03 seconds | 0.07 seconds | 0.17 seconds |
| Ink receptivity rating | 2 | 3 | 3 |

Example 4

A coating composition was prepared comprising: 50 parts SU26-248, 5 parts N-75, 25 parts Kraton solution (12.5% Kraton 1107 in toluene), 4 parts acrylic beads, 5 parts Cystat 609, and 31 parts MEK. 60 parts of this composition were combined with 1 part Cab-o-sil TS720 fumed silica to make composition 4A, and 60 parts of the coating composition were combined with 1 part Sasol alumina to make composition 4B. The two compositions were coated onto the oriented foam substrate using Meyer rod #18, and their properties were evaluated as shown in Table 5 below.

TABLE 5

| Composition | Ink receptivity rating | Static COF | Dynamic COF |
|---|---|---|---|
| 4A | 2 | 0.61 μs | 0.55 μk |
| 4B | 2 | 0.86 μs | 0.70 μs |

Note that ink receptivity was unaffected by the type of inorganic filler, but the coefficient of friction was better with the silica filler.

Comparative Example A

The uncoated oriented foam substrate was printed with wet offset ink. Antistatic properties of the substrate were poor with infinite static dissipation time. Ink receptivity score was 0 and friction was very high (evaluated qualitatively since quantitative tests could not be performed due to the high static of the substrate).

Comparative Example B

A coating composition comprising 10 parts SU26-248, 1 part N-75, and 15 parts Kraton solution (12.5% Kraton 1107 in toluene) was prepared by mixing all ingredients in a small vial. The composition was coated onto the oriented foam substrate using Meyer rod #18 to give a dry coating thickness of approximately 8 micrometers. The coated substrate was dried for 5 minutes in a 55° C. oven, then printed with wet offset ink. Antistatic properties of this substrate were poor with infinite static dissipation time. Ink receptivity score was 2, and friction was very high (evaluated qualitatively since quantitative tests could not be performed due to the high static of the substrate).

Comparative Example C

A coating composition comprising 12 parts SU26-248, 1.2 part N-75, 0.5 parts Cabosil TS-720, 0.7 parts acrylic beads, 12 parts MEK, and 1 part Cyastat 609 was prepared by mixing all ingredients in a small vial. The composition was coated onto the oriented foamed substrate using Meyer rod #18, and dried for 5 minutes in a 55° C. oven, then printed with wet offset ink. Ink receptivity of the coated substrate was very poor with a score of 0. Antistatic properties were excellent with dissipation time of 0.01 seconds.

Various embodiments of the invention have been described. These and other embodiments are within the scope of the following claims.

What is claimed is:

1. An ink receptive article comprising a substrate having applied on at least a portion thereof a layer of an ink receptive coating, wherein the ink receptive coating layer comprises a matrix of a crosslinked polyurethane polymer and a disperse phase within the matrix of an ink absorbing polymer, wherein the ink absorbing polymer has a solubility parameter of equal to or less than 9 $(cal/cm^3)^{1/2}$ and is a styrenic block copolymer.

2. The ink receptive article of claim 1, wherein the substrate is selected from an oriented foam layer, a multilayer optical film and a vapor coated film.

3. A security document comprising the ink receptive article of claim 1.

4. The ink receptive article of claim 1, wherein the ink receptive coating layer further comprises an antiblocking agent, and wherein the antiblocking agent comprises polymer beads having a diameter equal to or greater than the dry thickness of the ink receptive coating layer.

5. The ink receptive article of claim 1, wherein the styrenic block copolymer is selected from the group consisting of styrene-isoprene-styrene block copolymers, styrene-butadiene-styrene block copolymers, and styrene-ethylene-butylene-styrene copolymers.

6. The ink receptive article of claim 1, wherein the styrenic block copolymer is a styrene-isoprene-styrene block copolymer.

7. The ink receptive article of claim 1, wherein the ink absorbing polymer comprises at least 5% and up to 48% of the total polymer content of the ink receptive coating layer.

8. The ink receptive article of claim 1, wherein the ink absorbing polymer comprises between 15% to 35% of the total polymer content of the ink receptive coating layer.

9. The ink receptive article of claim 1, wherein the ink receptive coating layer further comprises 5% to 20% by weight of an ink absorber selected from the group consisting of metal oxides and silica.

10. The ink receptive article of claim 9, wherein the ink absorber comprises silica.

11. The ink receptive article of claim 1, wherein the ink receptive coating layer further comprises from 2% to 20% by weight of an antiblocking agent selected from glass microspheres, crosslinked polymer beads, and porous silica beads.

12. The ink receptive article of claim 1, wherein the ink receptive coating layer further comprises from 1% to 50% by weight of an antistatic agent.

13. The ink receptive article of claim 12, wherein the antistatic agent is a quaternary ammonium compound.

14. The ink receptive article of claim 1, further comprising an antistatic layer adjacent the ink receptive coating layer.

15. The ink receptive article of claim 1, wherein the ink receptive coating layer has a dry thickness of 1 μm to 50 μm.

* * * * *

UNITED STATES PATENT AND TRADEMARK OFFICE

CERTIFICATE OF CORRECTION

PATENT NO. : 8,003,176 B2
APPLICATION NO. : 11/538611
DATED : August 23, 2011
INVENTOR(S) : Caroline Melkonian Ylitalo It is certified that error appears in the above-identified patent and that said Letters Patent is hereby corrected as shown below:

In the Specifications:

Column 3
Line 49, delete -- "sprits," and insert -- spirits --, therefor.

Column 3
Line 66, delete -- "cylic" and insert -- cyclic --, therefor.

Column 4
Line 15, delete -- "polyacrlylics" and insert -- polyacrylics --, therefor.

Column 5
Line 60, delete -- "Billierica," and insert -- Billerica, --, therefor.
Line 63, delete -- "Wannington," and insert -- Warrington, --, therefor.

Column 6
Line 17, delete -- "pyrophylite" and insert -- pyrophyllite --, therefor.
Line 19, delete -- "diatomatious" and insert -- diatomaceous --, therefor.
Line 39, delete -- "Cyasort" and insert -- Cyasorb --, therefor.

Column 8
Line 28, delete -- "thereof," and insert -- thereof, --, therefor.
Line 30, delete -- "Wilimington," and insert -- Wilmington, --, therefor.
Line 35, delete -- "actetate" and insert -- acetate --, therefor.

Column 11
Line 42, delete -- "coalescense" and insert -- coalescence --, therefor.
Line 52, delete -- "coalescense" and insert -- coalescence --, therefor.

Signed and Sealed this
Fourteenth Day of May, 2013

Teresa Stanek Rea
*Acting Director of the United States Patent and Trademark Office*

Column 12
Line 22, delete -- “benzenesulfonhydrazide” and insert -- benzenesulfonylhydrazide --, therefor.

Column 20
Line 41, delete -- “Pittsburg,” and insert -- Pittsburgh, --, therefor.
Line 46, delete -- “Wannington,” and insert -- Warrington, --, therefor.

Column 22
Line 23, delete -- “Cystat” and insert -- Cyastat --, therefor.